US008305298B2

(12) United States Patent
Kim et al.

(10) Patent No.: US 8,305,298 B2
(45) Date of Patent: Nov. 6, 2012

(54) PLASMA DISPLAY APPARATUS AND METHOD OF DRIVING

(75) Inventors: Gun Su Kim, Gyeongsangbuk-do (KR); Yong Song, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1355 days.

(21) Appl. No.: 11/744,323

(22) Filed: May 4, 2007

(65) Prior Publication Data

US 2007/0257863 A1 Nov. 8, 2007

(30) Foreign Application Priority Data

May 4, 2006 (KR) ..... 10-2006-0040760

(51) Int. Cl.
*G09G 3/28* (2006.01)

(52) U.S. Cl. ..... 345/60; 345/61; 345/62; 345/63; 345/64; 345/65

(58) Field of Classification Search ..... 345/60–68, 345/204
See application file for complete search history.

(56) References Cited

U.S. PATENT DOCUMENTS

| | | | | |
|---|---|---|---|---|
| 6,529,177 | B2 * | 3/2003 | Nakamura | 345/60 |
| 6,624,587 | B2 * | 9/2003 | Kim | 315/169.1 |
| 6,956,331 | B2 * | 10/2005 | Lee et al. | 315/169.1 |
| 7,365,710 | B2 * | 4/2008 | Chung et al. | 345/60 |
| 7,375,703 | B2 * | 5/2008 | Jeong | 345/60 |
| 7,705,805 | B2 * | 4/2010 | Jung et al. | 345/60 |
| 7,969,386 | B2 * | 6/2011 | Jung et al. | 345/60 |
| 2002/0158822 | A1 | 10/2002 | Ishizuka et al. | |
| 2003/0090441 | A1 * | 5/2003 | Kim et al. | 345/60 |
| 2003/0107532 | A1 * | 6/2003 | Choi | 345/60 |
| 2004/0085262 | A1 * | 5/2004 | Lee | 345/41 |
| 2005/0225513 | A1 * | 10/2005 | Jung et al. | 345/63 |
| 2005/0231442 | A1 * | 10/2005 | Kim et al. | 345/60 |

FOREIGN PATENT DOCUMENTS

| | | | |
|---|---|---|---|
| CN | 1438619 | | 8/2003 |
| CN | 1567407 | | 1/2005 |
| CN | 1677462 | | 10/2005 |
| EP | 1324302 | | 7/2003 |
| EP | 1336950 | | 8/2003 |
| EP | 1359563 | | 11/2003 |
| EP | 1585096 | | 10/2005 |
| EP | 1615197 | A2 | 1/2006 |
| EP | 1752951 | | 2/2007 |
| KR | 1020050021877 | | 3/2005 |
| KR | 1020050037694 | | 4/2005 |
| KR | 1020050104591 | | 11/2005 |

OTHER PUBLICATIONS

Office Action with English translation from Chinese Patent Application No. 200710101738.7 dated Jan. 9, 2009.
European Patent Office, European Search Report for Application No. 07251891.3-2205, mailed Aug. 27, 2007 (8 pages).
European Patent Office Action for Application No. 07251891.3-2205 dated Oct. 14, 2010, 6 pages.

* cited by examiner

*Primary Examiner* — Grant Sitta
(74) *Attorney, Agent, or Firm* — Fish & Richardson P.C.

(57) ABSTRACT

A plasma display apparatus and method of driving the plasma display apparatus are described. The plasma display apparatus has a plasma display panel that has a first electrode, a second electrode, and a third electrode. The plasma display apparatus also includes a first driver, a second driver and a third driver. The first driver supplies to the first electrode a first signal that decreases gradually from a first voltage to a second voltage during a setdown period of a reset period. The third driver supplies to the third electrode a third signal that increases from a third voltage to a fourth voltage during the setdown period of the reset period.

19 Claims, 12 Drawing Sheets

PLASMA DISPLAY APPARATUS AND METHOD OF DRIVING

This application claims the benefit of Korean Patent Application No. 10-2006-0040760 filed on May 4, 2006, which is hereby incorporated by reference.

BACKGROUND

1. Technical Field

This document is related to a plasma display apparatus and a method of driving the plasma display apparatus.

2. Description of the Related Art

A plasma display apparatus includes a plasma display panel where electrodes are formed, and a driver supplying driving signals to the electrodes. The plasma display panel includes discharge cells partitioned by a barrier rib, and a phosphor is formed within the discharge cells.

When the driving signal is supplied to the electrode of the plasma display panel, a sustain discharge is generated within the discharge cell. As a result of the sustain discharge, discharge gas in the discharge cell generates vacuum ultraviolet rays, the vacuum ultraviolet rays excite the phosphor, and light is emitted from the phosphor.

Before the occurrence of the sustain discharge, a reset discharge initializing wall charges of the discharge cell, and an address discharge selecting a discharge cell where a sustain discharge will occur are generated within the discharge cell.

SUMMARY

In one general aspect, a plasma display apparatus includes a plasma display panel with a first electrode, a second electrode, and a third electrode. The plasma display apparatus also includes a first driver, a second driver and a third driver. The first driver supplies to the first electrode a first signal that decreases gradually from a first voltage to a second voltage during a setdown period of a reset period. The third driver supplies to the third electrode a third signal that increases from a third voltage to a fourth voltage during the setdown period of the reset period.

In another general aspect, driving a plasma display apparatus includes supplying to a first electrode a first signal that decreases gradually from a first voltage to a second voltage during a setdown period of a reset period, and supplying to a third electrode a third signal that increases from a third voltage to a fourth voltage during the setdown period of the reset period.

Implementations may include one or more of the following features. For example, the first and second electrodes may be a scan electrode and a sustain electrode formed on a front substrate. The third electrode may be an address electrode formed on a rear substrate.

During the reset period, wall charges in a discharge cell of the plasma display panel are initialized. During an address period that immediately follows the reset period, discharge cells to emit light are selected among the discharge cells of the plasma display apparatus. During the sustain period that immediately follows the sustain period, the selected discharge cells emit light.

The first signal may decrease from a fifth voltage to a sixth voltage during a pre-reset period that immediately precedes the reset period. The magnitude of the difference between the fifth voltage and the sixth voltage may be greater than 230 V. Also, the point in time when the first signal starts to decrease from the first voltage toward the second voltage during the setdown period may be different from the point in time when the third signal starts to increase from the third voltage toward the fourth voltage during the setdown period.

Other features will be apparent from the following description, including the drawings, and the claims.

DETAILED DESCRIPTION

Figure 1:
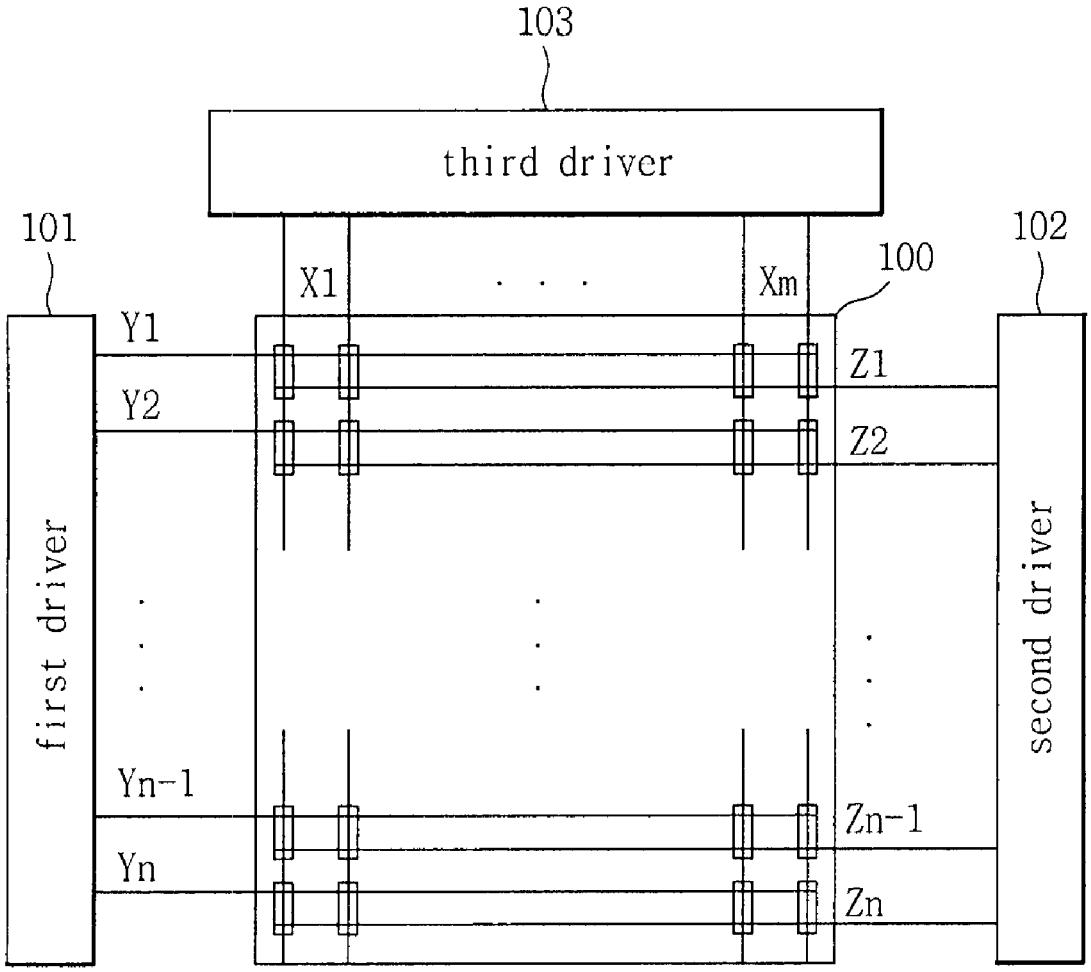
FIG. 1 is a block diagram of a plasma display apparatus.

FIG. 1 illustrates an exemplary block diagram of a plasma display apparatus. As illustrated in FIG. 1, the plasma display apparatus includes a plasma display panel 100, a first driver 101, a second driver 102 and a third driver 103.

The plasma display panel 100 includes a first electrode Y1, . . . , Yn, a second electrode Z1, . . . , Zn, and a third electrode X1, . . . , Xm.

The first driver 101 supplies, to the first electrode, a second falling ramp signal gradually falling from a fifth voltage to a third voltage during a set down period, and a scan signal falling from a scan bias voltage to a fourth voltage different from the third voltage during an address period.

The second driver 102 may supply a sustain bias signal to the second electrode during the setdown period of the reset period and the address period. Alternatively, the second driver 102 may supply the sustain bias signal during the address period after the setdown period of the reset period.

The third driver 103 supplies an address bias signal rising from a reference voltage to an address bias voltage to the third electrode during the setdown period of the reset period. The third driver 103 also supplies, to the third electrodes X1, . . . , Xm, a data signal for selecting a discharge cell where a sustain discharge will occur.

Figure 2:
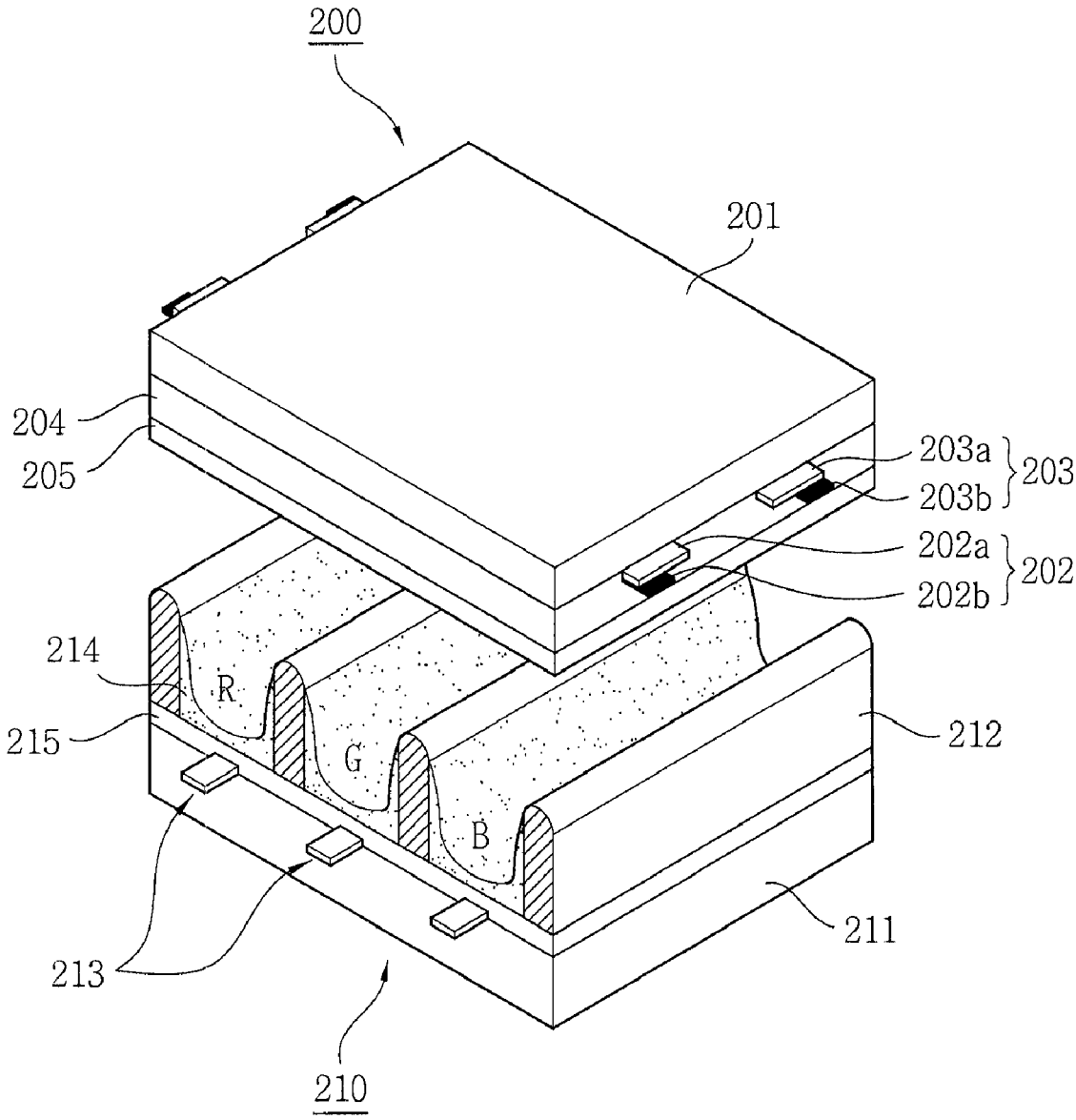
FIG. 2 is a perspective view of a portion of a plasma display panel of the plasma display apparatus of FIG. 1.

FIG. 2 illustrates a perspective view of an exemplary plasma display panel of the plasma display apparatus.

As illustrated in FIG. 2, the plasma display panel includes a front panel 200 and a rear panel 210. The front panel 200 includes a front substrate 201 where a first electrode 202 and a second electrode are formed. The rear panel 210 includes a rear substrate 211 where a third electrode 213 crossing the first electrode 202 and the second electrode 203 is formed.

An upper dielectric layer 204 covers the first electrode 202 and the second electrode 203. The upper dielectric layer 204 limits a discharge current of the first electrode 202 and the second electrode 203, and insulates the first electrode 202 and the second electrode 203.

Each of the first electrode 202 and the second electrode 203 includes a transparent electrode 202*a* or 203*a* and a bus electrode 202*b* or 203*b*. The transparent electrode 202*a* and 203*a* is made of Indium Tin Oxide to be pervious to light and the bus electrode 202*b* and 203*b* improves the electrical conductivity of the first electrode 102 and the second electrode 103.

The first electrode 202 and the second electrode 203 of FIG. 2 include the transparent electrodes 202*a* and 203*a* and the bus electrodes 202*b* and 203*b*. Alternatively, the first electrode 202 and the second electrode 203 may include only the bus electrodes 202*b* and 203*b*.

A protective layer 205 formed on the upper dielectric layer 204 emits secondary electrons, and improves the discharge condition. The protective layer 205 is formed by a deposion of magnecium oxide (MgO).

A lower dielectric layer 215 covers the third electrode 213. The lower dielectric layer 215 insulates the third electrodes 213.

A stripe type barrier or a well type barrier rib 212 is formed on the lower dielectric layer 215. The barrier rib 212 partitions discharge cells. Discharge gas fills the discharge cells. A phosphor layer 214 for emitting light is formed in the discharge cells.

Figure 3:
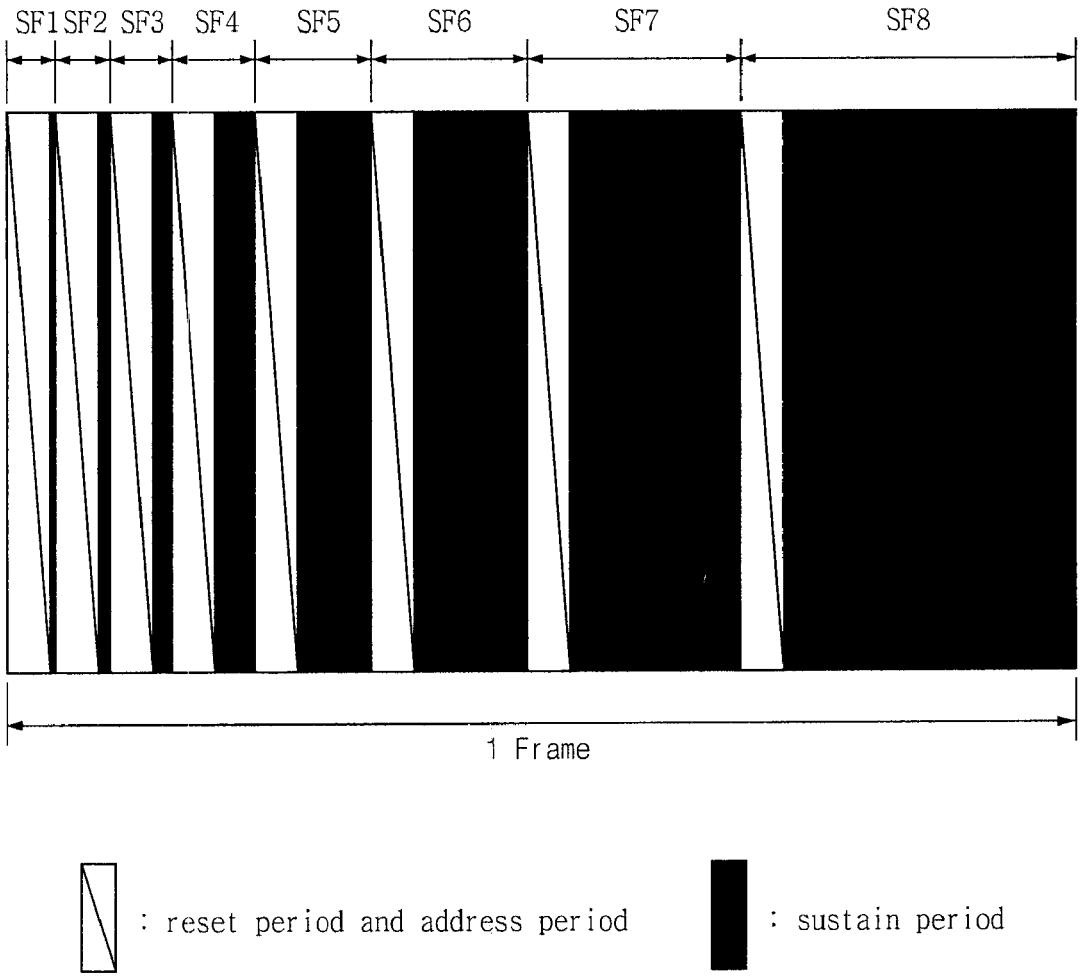
FIG. 3 is a timing diagram of plasma display apparatus signals.

FIG. 3 explains an exemplary method of implementing a gray scale of the plasma display apparatus.

As shown in FIG. 3, in order to implement a gray scale, each image frame is divided into a plurality of sub-fields SF1 to SF8. Each sub-field is subdivided into a reset period for initializing all of the discharge cells, an address period for selecting some of the discharge cells, and a sustain period with various durations for implementing the gray scale. For example, if it is desired to display an image with 256 gray scales, a frame period (16.67 ms) corresponding to 1/60 of one second is divided into eight sub-fields SF1 to SF8.

The time duration of and the number of sustain pulses in a sustain period increase by a ratio of 2n (where, n=0, 1, 2, 3, 4, 5, 6, 7) for each sub-field SF1 to SF8. For example, the time duration of a sustain period in sub-field SF2 is twice the time duration of a sustain period in sub-field SF1. As such, since the duration of a sustain period varies from one sub-field to the next, the gray scale of a discharge cell is controlled by properly selecting sustain periods during which the discharge cell emits light.

Figure 4A:
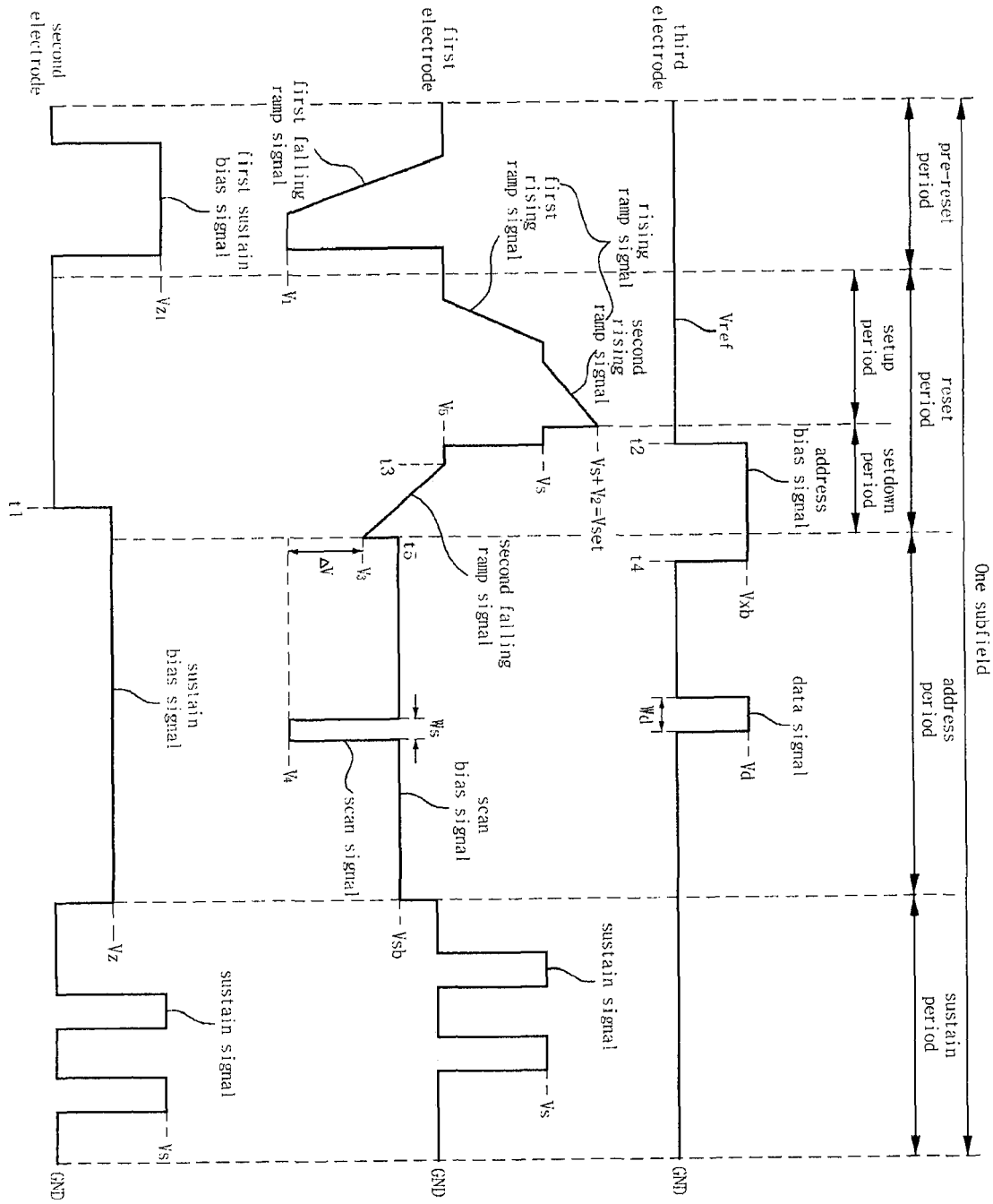
FIG. 4*a* is a graph of driving signals.

FIG. 4*a* illustrates exemplary waveforms of driving signals of the plasma display apparatus.

The first driver 101 of FIG. 1 supplies, to the first electrode, a first falling ramp signal gradually falling from a reference voltage to a first voltage V1 during a pre-reset period. The reference voltage may be the ground level voltage. At least one of the sub-fields in a single frame may include the pre-reset period. The slope of the first falling ramp signal may range between 0.0005 V/ns and 0.005 V/ns.

The magnitude of the difference between the first voltage V1 and the ground voltage may be more than the magnitude of the difference between the ground voltage and the highest voltage of a sustain signal supplied to at least one of the first electrode or the second electrode during a sustain period, and less than or equal to 1.5 times the magnitude of the difference between the ground voltage and the highest voltage of the sustain signal. The magnitude of the difference between the first voltage V1 and the ground voltage may range from 230 V to 250 V.

The voltage level of the first voltage V1 may be substantially equal to the voltage level of the fourth voltage level V4. Accordingly, one voltage source may supply the first voltage V1 and the fourth voltage V4, which makes the structure of the first driver 101 simple.

The second driver 102 supplies, to the second electrode, a first sustain bias signal rising from the ground level voltage GND to a first sustain bias voltage Vz1 during the pre-reset period. The magnitude of the first sustain bias voltage Vz1 is substantially equal to the magnitude of the highest voltage Vs of a sustain signal supplied to the second electrode during a sustain period. Accordingly, a single power supply may be used for both voltages Vz1 and Vs, which simplifies the structure of the second driver 102.

When the first falling ramp signal is supplied to the first electrode during the pre-reset period and the first sustain bias signal is supplied to the second electrode, a weak dark discharge i.e. a pre-reset discharge, occurs between the first electrode and the second electrode. As a result of the pre-reset discharge, positive wall charges are accumulated over the first electrode, and negative wall charges are accumulated over the second electrode. Accordingly, even with a relative low voltage level supplied to the first electrode, a stable setup discharge occurs during the reset period.

When the magnitude of the first voltage V1 is more than the magnitude of the highest voltage of the sustain signal and is less than or equal to 1.5 times the magnitude of the highest voltage of the sustain signal, a strong pre-reset discharge occurs and the distribution of wall charges in the discharge cells becomes uniform. Accordingly, the plasma display apparatus prevents the brightness point erroneous discharge, which generally occurs when the distribution is unstable.

The first driver 101 supplies, to the first electrode, a rising ramp signal rising from the ground level voltage to a setup voltage Vset during the setup period of the reset period. Because of the wall charges formed in the discharge cells during the pre-reset period, the magnitude of the setup voltage Vset does not need to be very high.

The rising ramp signal may include a first rising ramp signal having a first slope, and a second rising ramp signal having a second slope different from the first slope. The first rising ramp signal rises from the ground level voltage GND to a sustain voltage Vs, and the second rising ramp signal rises from the sustain voltage Vs to the setup voltage Vset. The sustain voltage Vs is the highest voltage of the sustain signal, and the setup voltage Vset is the sum of the sustain voltage Vs and a second voltage V2.

A magnitude of the second slope may be less than a magnitude of the first slope. When the magnitude of the second slope is less than the magnitude of the first slope, the voltage level on the first electrode increases rapidly before an occurrence of the setup discharge, and the voltage level on the first electrode increases slowly during the occurrence of the setup discharge. This causes the amount of light generated during the setup period to decrease, and improves the contrast characteristic. The slope of the first rising ramp signal may range between 0.0005 V/ns and 0.005 V/ns. The slope of the second rising ramp signal may range between 0.0005 V/ns and 0.005 V/ns.

The first driver 101 supplies a second falling ramp signal falling from a fifth voltage V5, which is lower than the setup voltage Vset, to a third voltage V3 during a setdown period of the reset period. The fifth voltage may be any voltage between the setup voltage Vset and the third voltage V3. Because of the second falling ramp signal, a weak erase discharge i.e. a setdown discharge, occurs in the discharge cells. Due to the setdown discharge, some of the wall charges accumulated at the discharge cells are erased, and wall charges in the discharge cells are uniformly distributed. The duration of the second falling ramp signal may be 15% or more of the length of the reset period. The slope of the second falling ramp signal may be less than or equal to 0.005 V/ns.

Figure 5A:
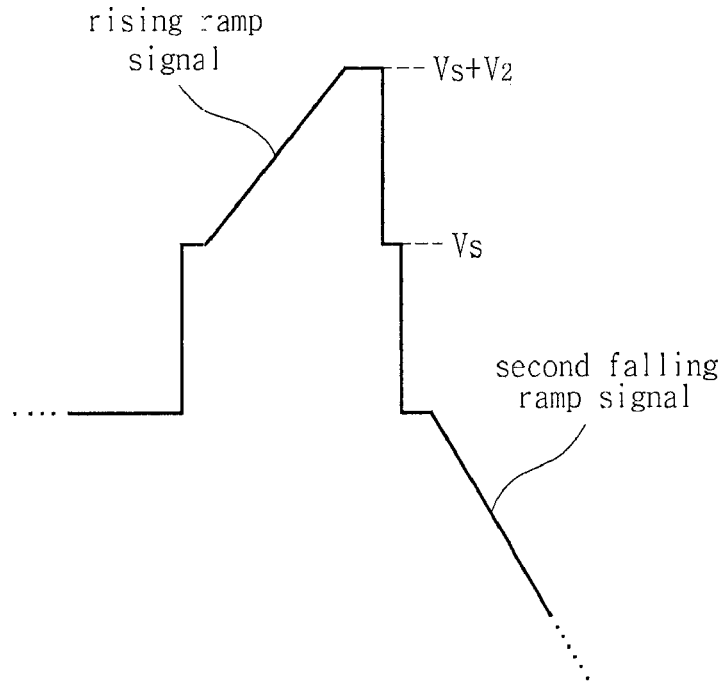
FIG. 5*a* to FIG. 5*c* are graphs of ramp signals.
Figure 5B:
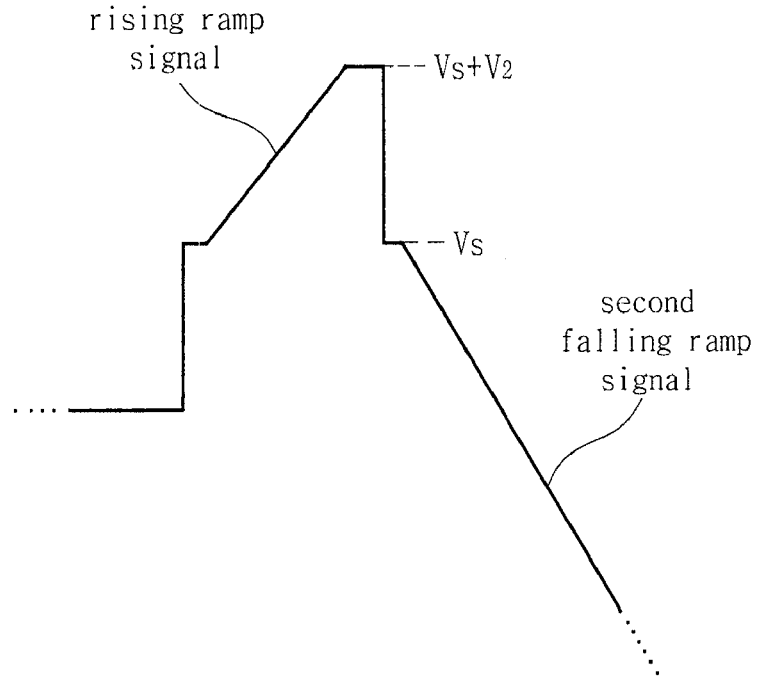
Figure 5C:
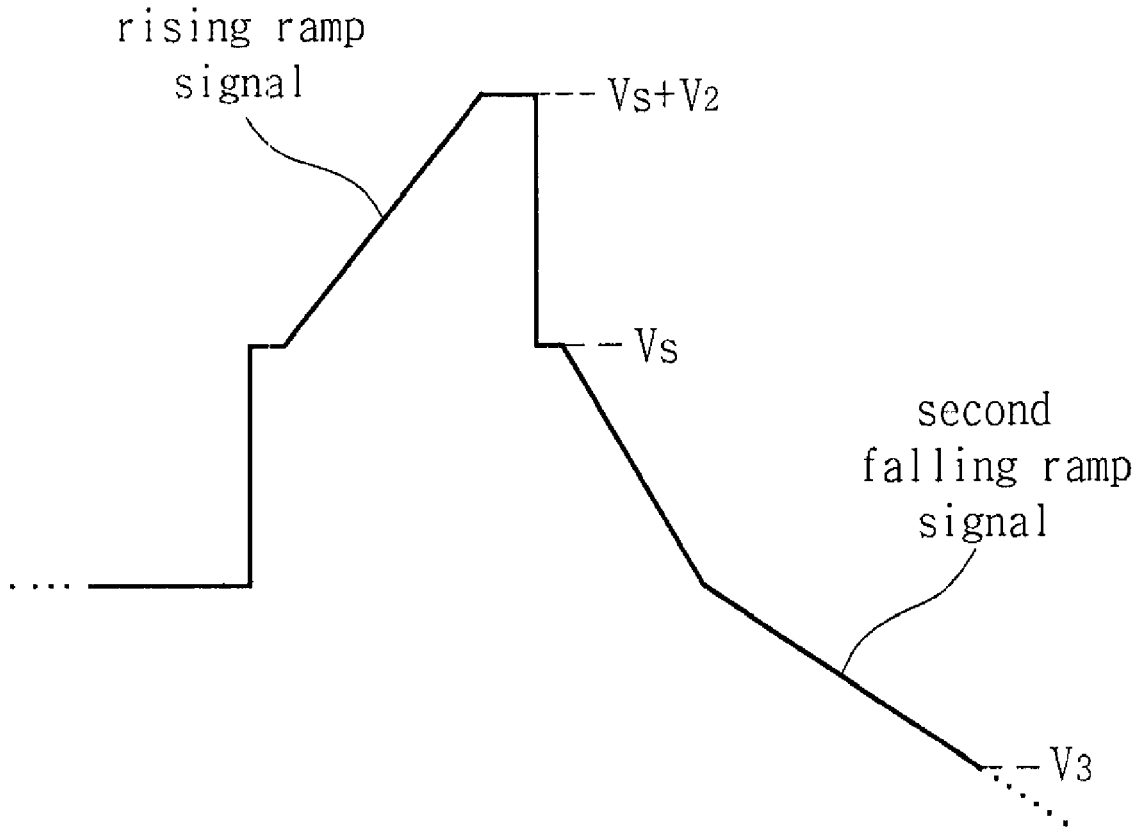

FIG. 5*a* to FIG. 5*c* illustrate another exemplary waveforms of a rising ramp signal and a second falling ramp signal.

As illustrated in FIG. 5*a*, the rising ramp signal may gradually rise from the sustain voltage Vs to the setup voltage Vset after the rising ramp signal rises to the sustain voltage Vs. As illustrated in FIG. 5*b*, the second falling ramp signal may gradually fall from the sustain voltage Vs. As illustrated in FIG. 5*c*, the slope of the second falling ramp signal varies while the second falling ramp signal falls from the sustain voltage Vs to the third voltage V3 gradually. By applying the rising ramp signals and the second falling ramp signals as illustrated in FIG. 5*a* to 5*c*, the amount of wall charges in the discharge cells can be controlled.

Figure 6A:
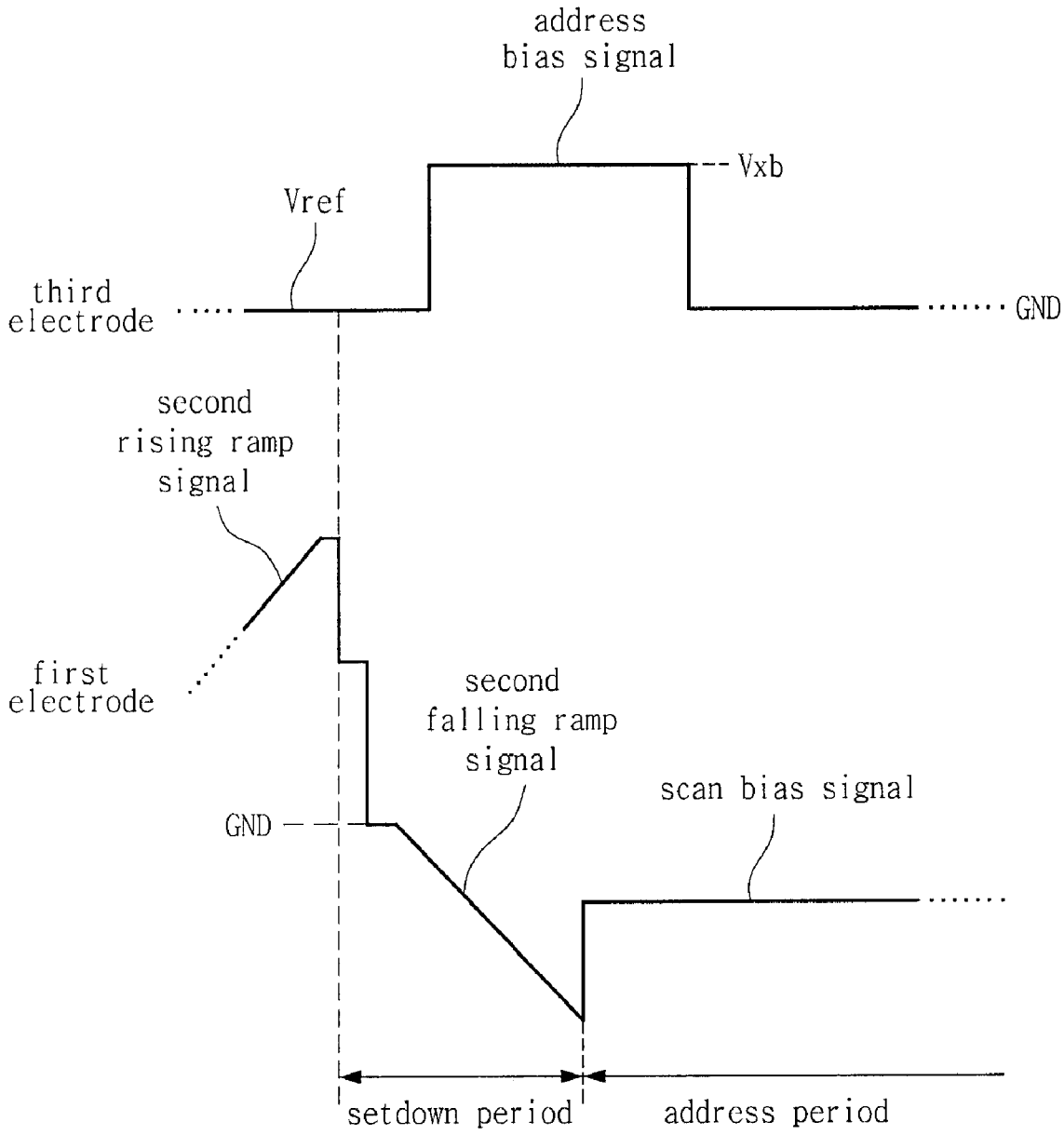
FIG. 6*a* and FIG. 6*b* are graphs of an address bias signal.
Figure 6B:
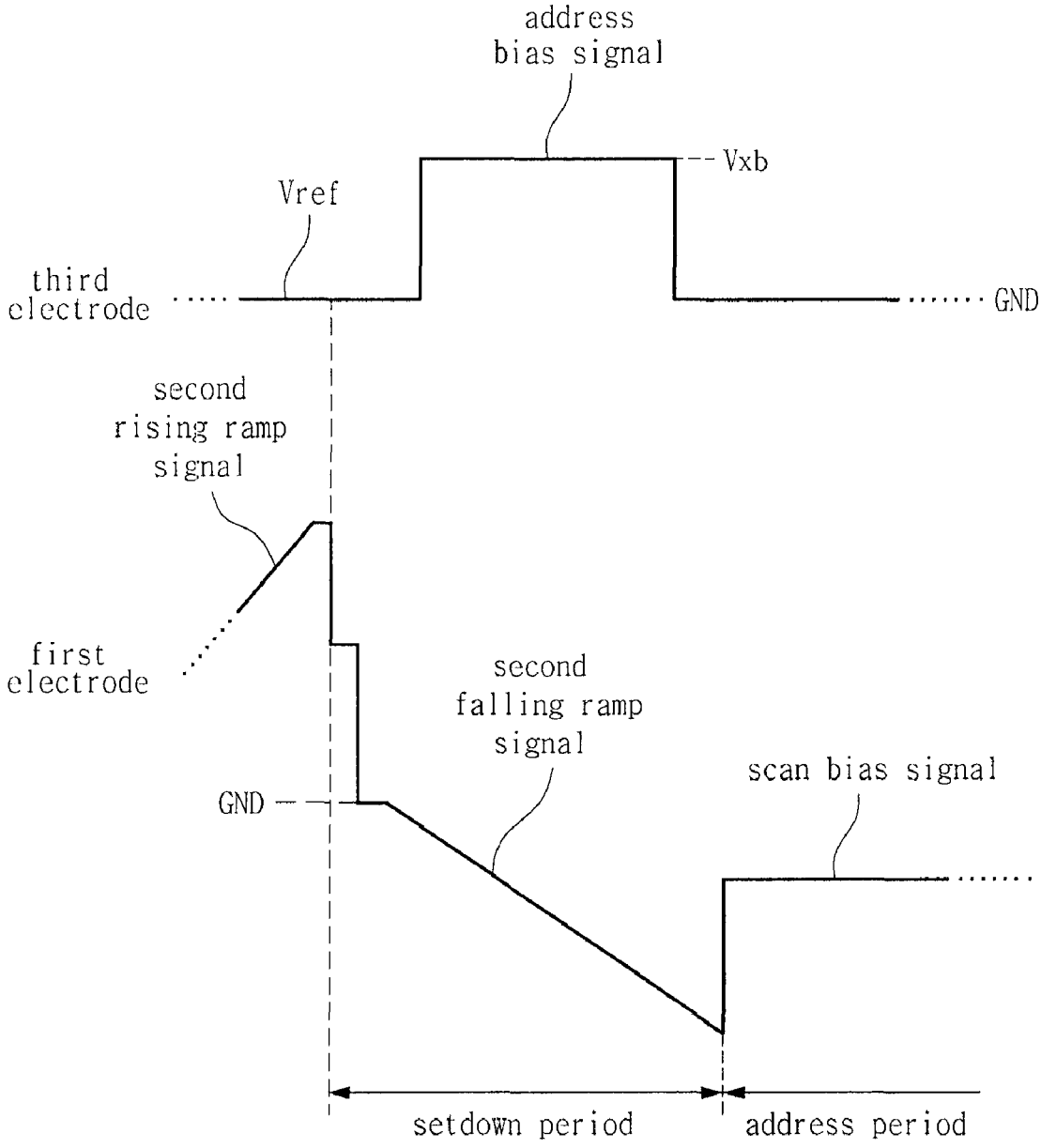

FIG. 6*a* and FIG. 6*b* illustrate exemplary waveforms of an address bias signal.

As illustrated in FIG. 6*a*, the third driver 103 supplies, to the third electrode, an address bias signal rising from a reference voltage to an address bias voltage Vxb during the setdown period of the reset period. The reference voltage may be the ground level voltage. A magnitude of the address bias voltage Vxb may be substantially equal to the magnitude of the highest voltage of the data signal supplied to the third electrode during the address period, i.e., a data voltage Vd. The transition of the address bial signal from the reference voltage to the address bias voltage Vxb may happen during the setdown period, and the transition from the address bial voltage Vxb to the reference voltage may happen during the address period.

The address bias signal makes the setdown discharge stable when the second falling ramp signal is supplied to the first electrode. The address bias signal is supplied to the third electrode before the application of the scan signal to the first electrode. As a result, the address discharge generated by the scan signal and the data signal becomes stable. When a strong pre-reset discharge occurs during the pre-reset period, due to light emitted by discharge cells during the pre-reset period, a black brightness increases and the contrast gets worse. An erroneous discharge may occur due to wall charges accumulated at the first electrode and the second electrode. Accordingly, the second falling ramp signal and the address bias signal limits the discharge between the first electrode and the second electrode, and generates a discharge between the first electrode and the third electrode. As a result of the second falling ramp signal and the address bias signal, a stable setdown discharge is generated.

Figure 4B:
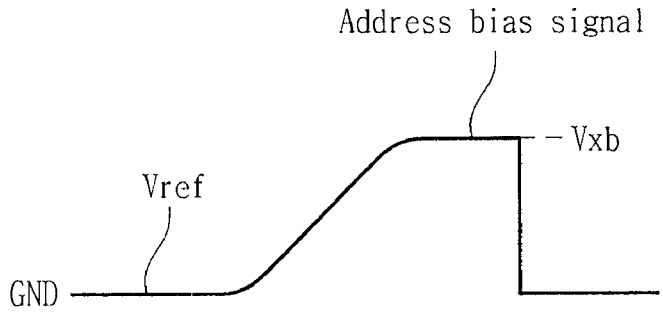
FIG. 4*b* is a graph of an address bias signal.

As illustrated in FIG. 4*b*, the third driver 103 may supply, to the third electrode, an address bias signal gradually rising from the reference voltage Vref to the address bias voltage Vxb. Such a gradual voltage change may decrease noise. The slope of the rising address bias signal may range between 0.1 V/ns and 1 V/ns.

Figure 4C:
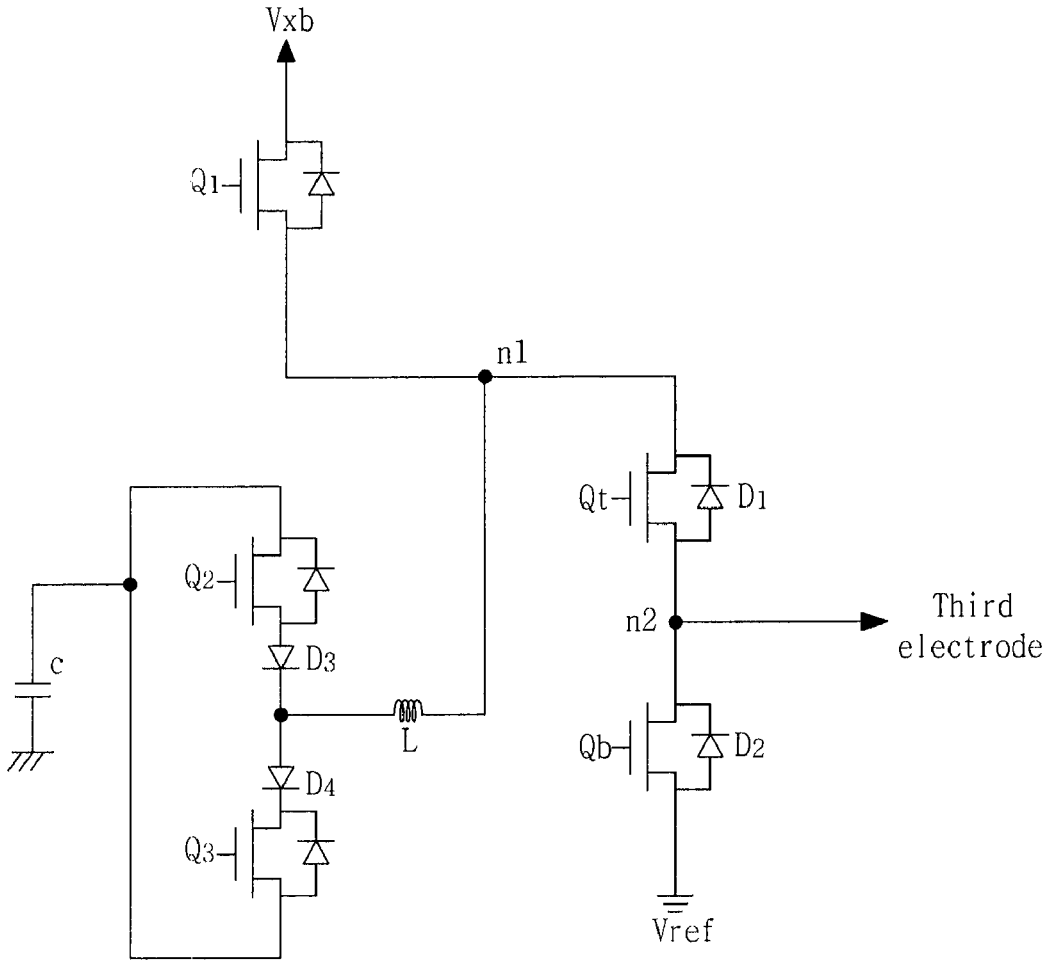
FIG. 4*c* is an exemplary circuit diagram of the third driver for generating the address bias signal of FIG. 4*b;*

The third driver 103 may generate the address bias signal as illustrate in FIG. 4*b* through a resonance circuit. FIG. 4*c* illustrates an exemplary circuit diagram of a third driver for generating the address bias signal of FIG. 4*b*. When a switch Qb is turned on and the remaining switches are turned off, the reference voltage Vref is supplied to the third electrode. When a switch Q2 and a switch Qt are turned on and the remaining switches are turned off, the energy stored at a capacitor C is supplied to the third electrode through the switch Q2, an inductor L, and the switch Qt. Accordingly, the voltage on the third electrode rises from the reference voltage Vref to the address bias voltage Vxb gradually. When a switch Q1 and the switch Qt are turned on and the remaining switches are turned off, the voltage level on the third electrode is maintained at the address bias voltage Vxb. When the switch Qb is turned on and the remaining switches are turned off, the reference voltage Vref is supplied to the third electrode.

A supply start time point t3 of the second falling ramp signal in FIG. 4*a*, when the second falling ramp signal start to fall, may be different from a supply start time point t2 of the address bias signal. When the supply start time point t3 of the second falling ramp signal is different from the supply start time point t2 of the address bias signal, noise generated between the first electrode and the third electrode can be reduced. A supply end time point of the address bias signal t4 is different from a supply end time point t5 of the second falling ramp signal. Accordingly, noise generated between the first electrode and the third electrode can be reduced.

As illustrated in FIG. 6*b*, the address bias signal may be supplied only during the setdown period when the second falling ramp signal is supplied.

As illustrated in FIG. 4*a*, the first driver 101 supplies, to the first electrode, a scan bias signal and the scan signal, which falls from a scan bias voltage Vsb to the fourth voltage V4, maintains at the fourth voltage V4 and rises to the scan bias voltage Vsb, during the address period.

Figure 7:
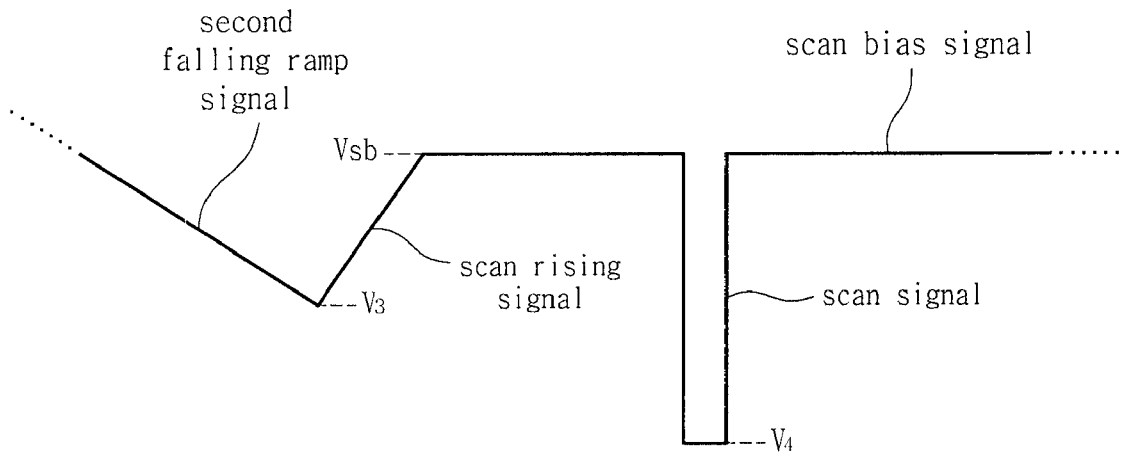
FIG. 7 is a graph of a scan signal including a scan rising signal.

FIG. 7 illustrates another exemplary waveform of a scan signal including a scan rising signal. The scan rising signal gradually rising from the third voltage V3 to the scan bias voltage Vsb is supplied between the applications of the second falling ramp signal and the scan bias signal. The scan rising signal reduces the coupling effect generated between adjacent first electrodes. Accordingly, noise and an electro magnetic interference generated by the coupling effect is reduced. The slope of the scan rising signal may range between 0.001 V/ns and 1 V/ns.

Figure 8:
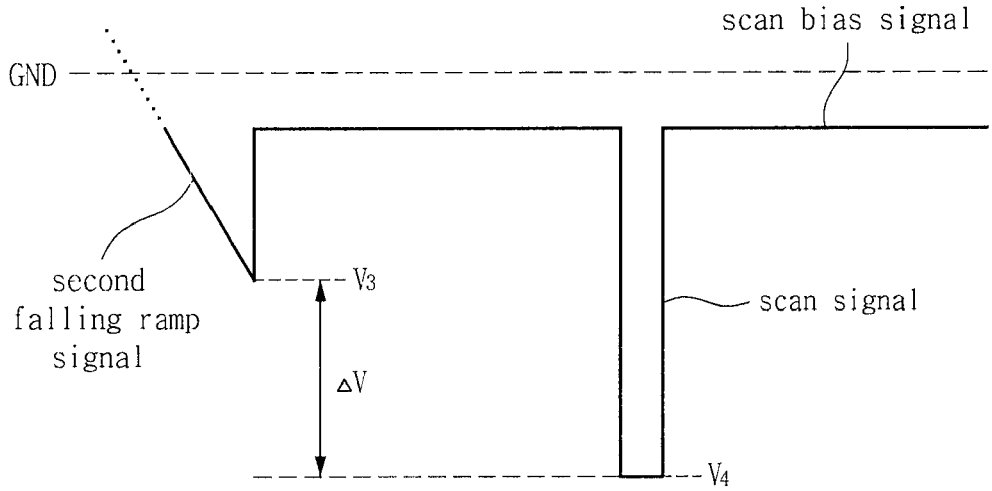
FIG. 8 is a graph of the second falling ramp signal and the scan signal.

FIG. 8 illustrates detailed waveforms of the second falling ramp signal and the scan signal as illustrated in FIG. 4*a*. Referring to FIG. 8, the following equation 1 explains the relationship between ΔV and Vd. ΔV refers to the difference between the magnitude of the third voltage V3 of the second falling ramp signal and the magnitude of the fourth voltage V4 of the scan signal. Vd refers to the magnitude of the highest voltage of the data signal supplied to the third electrode during the address period, as illustrated in FIG. 4*a*.

$$Vd-10\text{ V} \leqq \Delta V \leqq Vd+30\text{ V} \quad \text{[equation 1]}$$

When ΔV satisfies equation 1, a stable address discharge is generated.

ΔV may satisfy the following equation 2.

$$Vd \leqq \Delta V \leqq Vd+20\text{ V} \quad \text{[equation 2]}$$

When ΔV satisfies equation 2, a stable address discharge is generated, and a withstanding voltage characteristic of the first driver 101 is improved. For the stable address discharge, ΔV may range from 50 V to 60 V.

The second falling ramp signal and the address bias signal are supplied in order to prevent an increase of the black brightness and the erroneous discharge between the first electrode and the second electrode. As a result of the application of the second falling ramp signal and the address bias signal, however, the amount of positive wall charges at the third electrode is reduced. Because of the reduction of the amount of the positive wall charges, an address discharge may not occur even if a data signal is supplied to the third electrode. In other words, an unstable address discharge may occur. For a stable address discharge, ΔV satisfies the equation 1 or the equation 2.

The third driver 103 supplies the data signal corresponding to the scan signal to the third electrode during the address period. Referring to FIG. 4*a*, the width of the scan signal Ws may be different from the width Wd of the data signal. Accordingly, the duration of the address period can be reduced, and a stable address discharge can be generated.

Referring to FIG. 4*a*, the data signal rises from the ground level voltage GND to the data voltage Vd during the address period. The magnitude of a highest voltage of the data signal, i.e., the data voltage Vd, may range from 40 V to 50 V. As long as ΔV satisfies the equation 1 or 2, the magnitude of the data voltage can be reduced and a stable address discharge can still be generated. Because the data voltage Vd is reduced, the third driver 103 can include an inexpensive switch having a low withstanding voltage.

As illustrated in FIG. 4*a*, the second driver 102 supplies, to the second electrode, a sustain bias signal rising from the ground level voltage GND to a sustain bias voltage Vz during the setdown period of the reset period and the address period. A supply start time point t1 of the address bias signal may be different from a supply start time point t2 of the sustain bias signal. As a result of the difference of the supply start time point t1 and the supply start time point t2, the stable setdown discharge is generated by the address bias signal while preventing the generation of a peak pulse.

As illustrated in FIG. 4*a*, the magnitude of the highest voltage of the sustain bias signal Vz may be less than the magnitude of the highest voltage of the first sustain bias signal Vz1.

Figure 9:
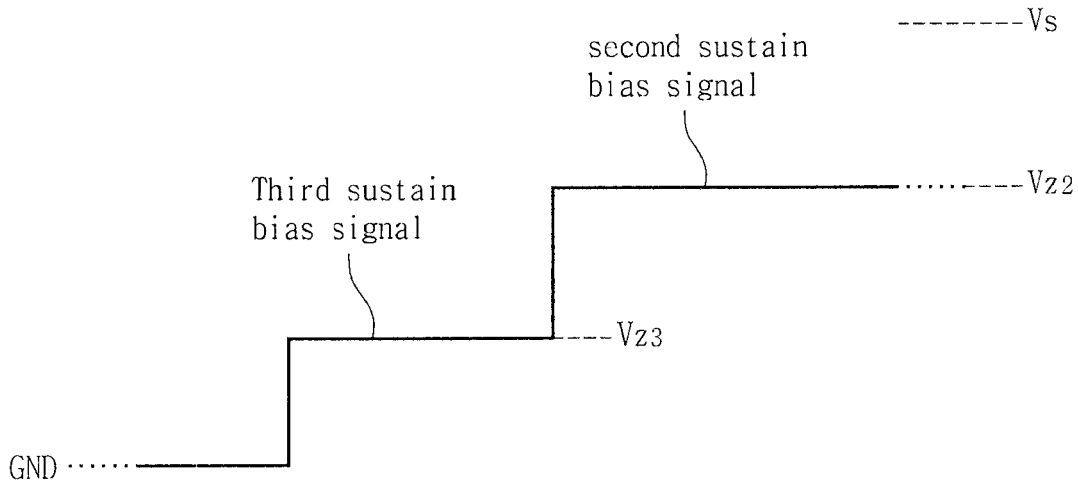
FIG. 9 is a graph of a sustain bias signal.

FIG. 9 illustrates another exemplary waveform of the sustain bias signal. As illustrated in FIG. 9, the sustain bias signal may include a third sustain bias signal rising from the ground level voltage GND to a third sustain bias voltage Vz3, and a second sustain bias signal rising from the third sustain bias voltage Vz3 to the second sustain bias voltage Vz2. The magnitude of the highest voltage of the third sustain bias signal, i.e., the third sustain bias voltage Vz3, may be less than the magnitude of the highest voltage of the second sustain bias signal, i.e., the second sustain bias voltage Vz2. When the magnitude of the third sustain bias voltage Vz3 is less than the magnitude of the second sustain bias voltage Vz2, the amount of the variation of the third voltage V3 and the noise decrease. The magnitude of the second sustain bias voltage Vz2 may be less than the magnitude of the first sustain bias signal Vz1.

The magnitude of the sustain bias voltage Vz of FIG. 4*a* or the second sustain bias voltage Vz2 of FIG. 9 may range from 40 V to 50 V. When the magnitude of the sustain bias voltage Vz or the second sustain bias voltage Vz2 ranges from 40 V to 50 V, the sustain bias signal or the second sustain bias signal can prevent an erroneous discharge generated by an interference between the first electrode and the second electrode during the address period.

The magnitude of the second sustain bias voltage Vz2 may be substantially equal to the magnitude of the address bias voltage Vxb or the magnitude of the data voltage Vd. Accordingly, a separate bias circuit for generating the second sustain bias voltage Vz2 is not needed, and the manufacturing cost of the plasma display apparatus can be reduced.

Figure 10:
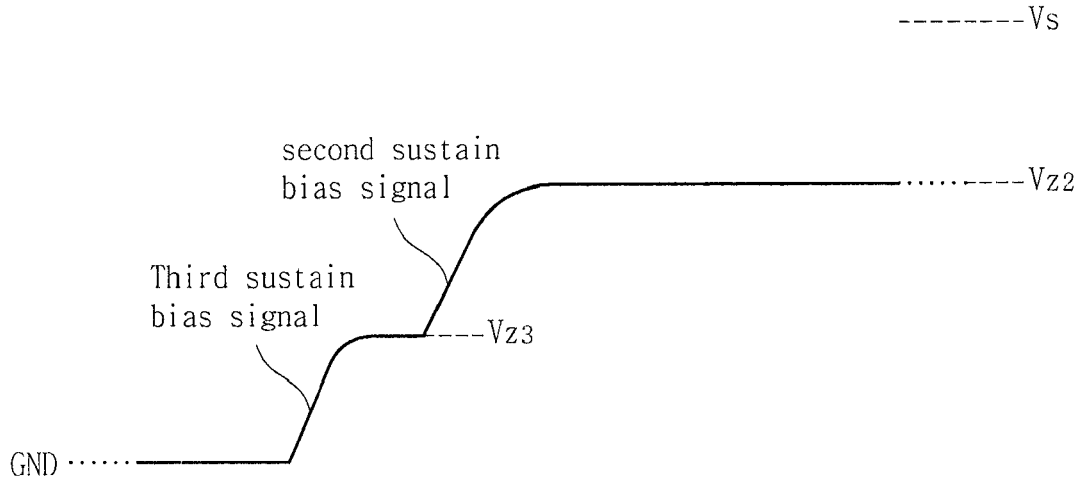
FIG. 10 is a graph of the sustain bias signal.

FIG. 10 illustrates another exemplary waveform of the sustain bias signal. As illustrated in FIG. 10, a sustain bias signal may include a third sustain bias signal gradually rising from the ground level voltage GND to the third sustain bias voltage Vz3, and a second sustain bias signal gradually rising from the third sustain bias voltage Vz3 to the second sustain bias voltage Vz2. The gradually rising third sustain bias signal and second sustain bias signal can reduce noise and an electro magnetic interference. The slope of the rising third sustain bias signal may range between 0.001 V/ns and 1 V/ns. The slope of the rising second sustain bias signal may range between 0.001 V/ns and 1 V/ns.

Referring to FIG. 4*a*, a sustain signal is applied to at least one of the first electrode and the second electrode during the sustain period. As a result of the application of the sustain signal, the discharge cells selected during the address period emit light.

Figure 11:
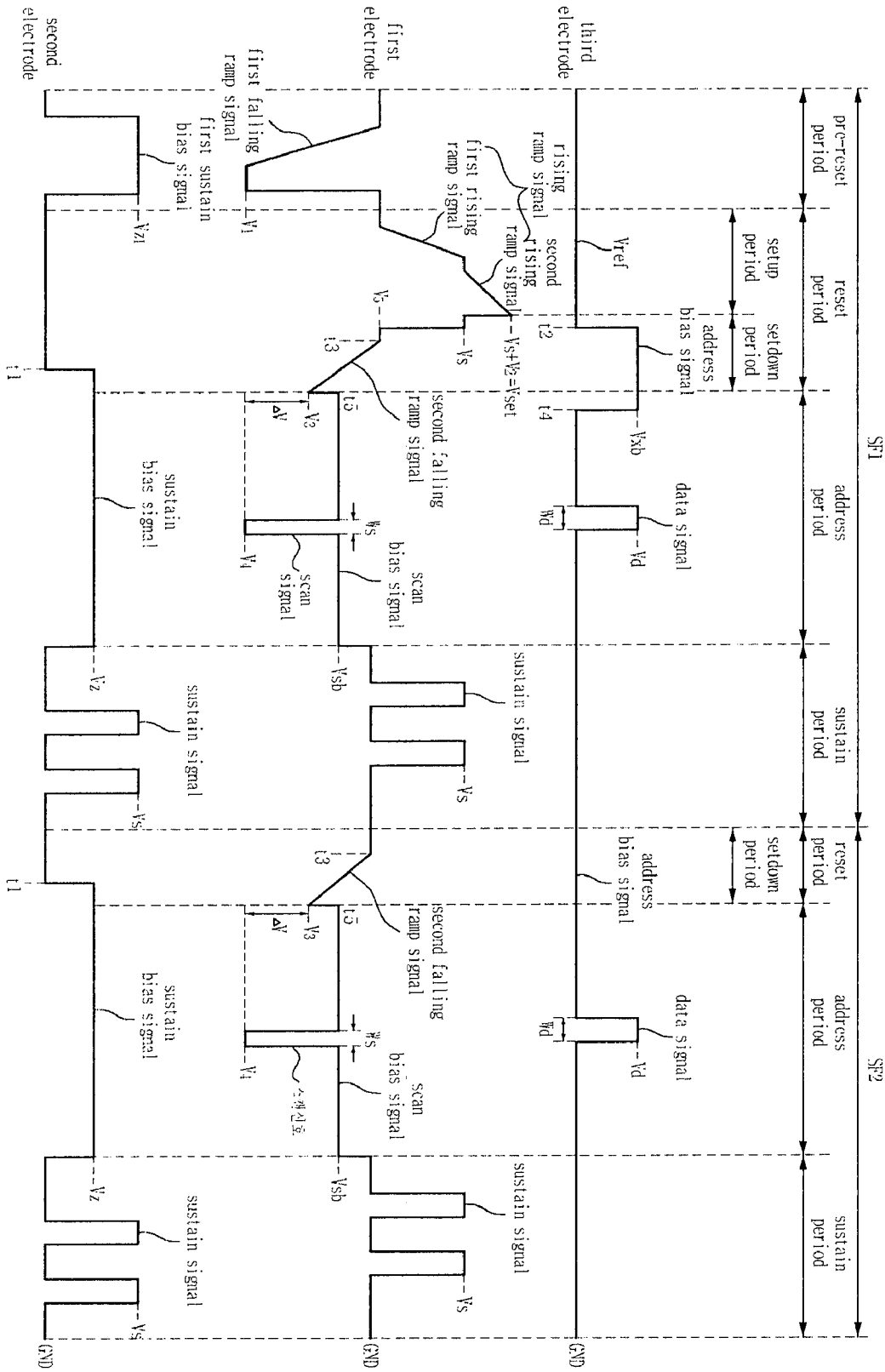
FIG. 11 is graph of driving signals of the plasma display apparatus.

FIG. 11 illustrates another exemplary waveforms of the driving signals of the plasma display apparatus. As illustrated FIG. 11, the first driver 101 may supply the rising ramp signal rising to the setup voltage Vset during the setup period of subfield SF1 among subfields SF1 and SF2, and the third driver 103 may supply the address bias signal during the address period of subfield SF1 among subfields SF1 and SF2. Accordingly, the amount of light emitted from the discharge cell decreases during the subfields other than subfield SF1, and the contrast characteristic is improved.

Other implementations are within the scope of the following claims.

What is claimed is:

1. A plasma display apparatus comprising:

a plasma display panel including a first electrode, a second electrode, and a third electrode;

a first driver configured to supply, to the first electrode, a first signal that decreases gradually from a first voltage to a second voltage during a setdown period of a reset period, and supply a scan signal and a scan bias signal to the first electrode during an address period that immediately follows the reset period;

a second driver configured to supply a first sustain bias signal to the second electrode during the setdown period and the address period; and a third driver configured to supply, to the third electrode, a third signal that increases from a third voltage to a fourth voltage and then decreases from the fourth voltage to the third voltage, and supply, to the third electrode, a data signal during the address period, wherein an application time point of the third signal precedes an application time point of the first signal, and an end time point of the third signal follows an end time point of the first signal, wherein an application time point of the first sustain bias signal follows an application time point of the first signal, and the application time point of the first sustain bias signal precedes the end time point of the first signal, and wherein an application time point of the scan bias signal precedes the end time point of the third signal.

2. The plasma display apparatus of claim 1, wherein the first driver controls the first signal to decrease gradually from a fifth voltage to a sixth voltage during a pre-reset period that immediately precedes the reset period.

3. The plasma display apparatus of claim 2, wherein the first driver controls the first signal to decrease from a seventh voltage to an eighth voltage that is substantially equal to the sixth voltage during an address period that follows the reset period.

4. The plasma display apparatus of claim 2, wherein the first driver controls the first signal to increase from a ground voltage to a ninth voltage during a sustain period that follows an address period, and wherein a magnitude of a difference between the fifth voltage and the sixth voltage ranges between 1 and 1.5 times a magnitude of a difference between the ninth voltage and the ground voltage.

5. The plasma display apparatus of claim 1, wherein the first driver controls the first signal to decrease from a seventh voltage to an eighth voltage different from the second voltage during an address period that follows the reset period.

6. The plasma display apparatus of claim 5, wherein a magnitude of a difference (deltav) between the eighth voltage and the second voltage in terms of a magnitude of a difference (Vxb) between the fourth and third voltages is Vxb−10<deltav<Vxb+30).

7. The plasma display apparatus of claim 5, wherein the third driver controls the third signal to increase from the third voltage to a tenth voltage during the address period and wherein a magnitude of a difference (deltav) between the eighth voltage and the second voltage in terms of a magnitude of a difference (Vd) between the third and tenth voltages is Vd−10<deltav<Vd+30.

8. The plasma display apparatus of claim 7, wherein the magnitude of the difference (deltav) between the eighth voltage and the second voltage in terms of the magnitude of the difference (Vd) between the third and tenth voltages is Vd.l-toreq.deltav.ltoreq. Vd+20.

9. The plasma display apparatus of claim 1, wherein the first signal continuously decreases from the first voltage to the second voltage during a first period of the setdown period of the reset period, and a length of the first period is 15% or more of a length of the reset period.

10. The plasma display apparatus of claim 1, wherein the first signal continuously decreases from the first voltage to the second voltage during a first period of the setdown period of the reset period, and a slope of the first signal during the first period is less than or equal to 0.005 V/ns.

11. The plasma display apparatus of claim 1, wherein the second driver further supplies a second sustain bias signal to the second electrode during a pre-reset period that immediately precedes the reset period.

12. The plasma display apparatus of claim 11, wherein a magnitude of a highest voltage of the first sustain bias signal is less than a magnitude of a highest voltage of the second sustain bias signal.

13. The plasma display apparatus of claim 1, wherein the third driver controls the third signal to increase from the third voltage to a tenth voltage which is substantially same to the fourth voltage during an address period that follows the reset period.

14. A method of driving a plasma display apparatus including a first electrode, a second electrode and a third electrode, comprising:

supplying, to the first electrode, a first signal that decreases gradually from a first voltage to a second voltage during a setdown period of a reset period, and supplying a scan signal and a scan bias signal to the first electrode during an address period following the reset period;

supplying a first sustain bias signal to the second electrode during the setdown period and the address period; and supplying, to the third electrode, a third signal that increases from a third voltage to a fourth voltage and then decreases from the fourth voltage to the third voltage, and supplying a data signal to the third electrode during the address period, wherein an application time point of the third signal precedes an application time point of the first signal, and an end time point of the third signal follows an end time point of the first signal, wherein an application time point of the first sustain bias signal follows an application time point of the first signal, and an application time point of the first sustain bias signal precedes the end time point of the first signal, and wherein an application time point of the scan bias signal precedes the end time point of the third signal.

15. The method of claim 14, further comprising controlling the first signal to decrease from a seventh voltage to an eighth voltage different from the second voltage during an address period that follows the reset period.

16. The method of claim 15, wherein a magnitude of a difference (deltav) between the eighth voltage and the second voltage in terms of a magnitude of a difference (Vxb) between the fourth and third voltages is Vxb−10<deltav<Vxb+30).

17. The method of claim 15, further comprising controlling the third signal to increase from the third voltage to a tenth voltage during the address period, wherein a magnitude of a difference (deltav) between the eighth voltage and the second voltage in terms of a magnitude of a difference (Vd) between the third and tenth voltages is Vd−10<deltav<Vd+30.

18. A method of driving a plasma display apparatus including a first electrode, a second electrode and a third electrode, comprising:

supplying to the first electrode a first signal that decreases gradually from a first voltage to a second voltage during a setdown period of a reset period, and supplying a scan signal and a scan bias signal to the first electrode during an address period following the reset period;

supplying a first sustain bias signal to the second electrode during the setdown period and the address period; and supplying, to the third electrode, a third signal that increases from a third voltage to a fourth voltage and then decreases from the fourth voltage to the third voltage, and supplying, to the third electrode, a data signal during the address period, wherein an application time point of the third signal precedes an application time point of the first signal, and an end time point of the third signal follows an end time point of the first signal, wherein an application time point of the first sustain bias signal follows an application time point of the first signal, and the application time point of the first sustain bias signal precedes the end time point of the first signal, wherein an application time point of the scan bias signal precedes the end time point of the third signal, and wherein the first sustain bias signal includes a first part in which the voltage of the first sustain bias signal gradually rises with a first constant slope, a second part in which a slope of the first sustain bias signal gradually decreases, a third part in which the voltage of the first sustain bias signal is held at a third sustain bias voltage, a fourth part in which the voltage of the first sustain bias signal gradually rises with a second constant slope, a fifth part in which a slope of the first sustain bias signal gradually decreases, a sixth part in which the voltage of the first sustain bias signal is held at a second sustain bias voltage that is higher than the third sustain bias voltage.

19. A method of driving a plasma display apparatus including a first electrode, a second electrode and a third electrode, comprising:

during a first subfield:

supplying, to the first electrode, a rising ramp signal having a gradually rising voltage, a first signal that decreases gradually from a first voltage to a second voltage during a setdown period of a reset period, and a scan signal and a scan bias signal during an address period that follows the reset period;

supplying a first sustain bias signal to the second electrode during the setdown period and the address period; and supplying, to the third electrode, a third signal that increases from a third voltage to a fourth voltage and then decreases from the fourth voltage to the third voltage, and supplying, to the third electrode, a data signal during the address period, wherein an application time point of the third signal precedes an application time point of the first signal, and an end time point of the third signal follows an end time point of the first signal, wherein an application time point of the first sustain bias signal follows an application time point of the first signal, and the application time point of the first sustain bias signal precedes the end time point of the first signal, wherein an application time point of the scan bias signal precedes the end time point of the third signal, and wherein the first sustain bias signal includes a first part in which the voltage of the first sustain bias signal gradually rises with a first constant slope, a second part in which a slope of the first sustain bias signal gradually decreases, a third part in which the voltage of the first sustain bias signal is held at a third sustain bias voltage, a fourth part in which the voltage of the first sustain bias signal gradually rises with a second constant slope, a fifth part in which a slope of the first sustain bias signal gradually decreases, a sixth part in which the voltage of the first sustain bias signal is held at a second sustain bias voltage that is higher than the third sustain bias voltage; and during a second subfield:

supplying, to the first electrode, the first signal that decreases gradually from the first voltage to the second voltage during a setdown period of a reset period, and the scan signal and the scan bias signal during an address period that follows the reset period;

supplying the first sustain bias signal to the second electrode during the setdown period and the address period;

supplying, to the third electrode, the data signal during the address period; and withholding the rising ramp signal having the gradually rising voltage and the third signal, wherein an application time point of the first sustain bias signal follows an application time point of the first signal, and the application time point of the first sustain bias signal precedes the end time point of the first signal, and wherein an application time point of the scan bias signal precedes the end time point of the third signal.

* * * * *